US008079321B2

(12) United States Patent
Balasubramanian

(10) Patent No.: US 8,079,321 B2
(45) Date of Patent: Dec. 20, 2011

(54) LONG TANK FSRU/FLSV/LNGC

(75) Inventor: Sathish Balasubramanian, Houston, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 226 days.

(21) Appl. No.: 12/513,649

(22) PCT Filed: Oct. 18, 2007

(86) PCT No.: PCT/US2007/022215

§ 371 (c)(1), (2), (4) Date: May 5, 2009

(87) PCT Pub. No.: WO2008/076168

PCT Pub. Date: Jun. 26, 2008

(65) Prior Publication Data

US 2010/0018453 A1 Jan. 28, 2010

Related U.S. Application Data

(60) Provisional application No. 60/875,277, filed on Dec. 15, 2006.

(51) Int. Cl.
*B63B 25/08* (2006.01)

(52) U.S. Cl. ..... 114/74 R; 114/125

(58) Field of Classification Search ..... 114/74 R, 114/125

See application file for complete search history.

(56) References Cited

U.S. PATENT DOCUMENTS

| | | | |
|---|---|---|---|
| 3,054,373 | A | 9/1962 | Ripley |
| 3,332,386 | A | 7/1967 | Massac |
| 3,422,781 | A | 1/1969 | Field et al. |
| 3,482,541 | A | 12/1969 | Kanbe |
| 3,759,209 | A | 9/1973 | Iarossi et al. |
| 3,941,272 | A | 3/1976 | McLaughlin |
| 3,968,353 | A | 7/1976 | Kuller |
| 5,727,492 | A | 3/1998 | Cuneo et al. |
| 6,494,271 | B2 | 12/2002 | Wilson |
| RE38,697 | E | 2/2005 | Swann et al. |
| 2004/0172803 | A1 | 9/2004 | Gulati |
| 2004/0188446 | A1 | 9/2004 | Gulati et al. |
| 2005/0150443 | A1 | 7/2005 | Noble et al. |
| 2005/0193938 | A1 | 9/2005 | Boatman et al. |

FOREIGN PATENT DOCUMENTS

WO WO 2005/045305 A1 5/2005

*Primary Examiner* — Stephen Avila

(57) ABSTRACT

A method and apparatus for storing liquid within a storage tank such that a natural resonance of fluid motion of the stored fluid falls between natural resonance periods of a floating vessel that includes the storage tank. As a result, resonant energy of the floating vessel imparted to fluid stored in the storage tank may be controlled and sloshing loads may be reduced, thereby avoiding damage to the floating vessel.

23 Claims, 8 Drawing Sheets

LONG TANK FSRU/FLSV/LNGC

REFERENCE TO PRIORITY APPLICATION

This application is the National Stage of International Application No. PCT/US2007/022215, filed 18 Oct. 2007, which claims the benefit of U.S. Provisional Application No. 60/875,277, filed on 15 Dec. 2006.

BACKGROUND OF THE INVENTION

1. Field of the Invention

Embodiments of the present invention generally relate to the marine storage of liquefied natural gas, and more particularly, to the design and construction of marine storage tanks that possess strength and stability against loads caused by the stored fluids and the environment.

2. Description of Related Art

Clean burning natural gas has become the fuel of choice in many industrial and consumer markets around the industrialized world. When natural gas sources are located in remote locations, relative to the commercial markets desiring the natural gas, a mechanism to transport the natural gas to market is needed. One such mechanism may include transporting the natural gas through pipelines in gaseous form or may include transporting the natural gas in liquid form via large-volume marine vessels.

Vessels designed to carry liquefied natural gas (LNG) may involve large capital expense in comparison to other cargo carrying systems. This may be in part due to the cryogenic temperature required to maintain LNG in a liquid state under near ambient pressure for long sea-transit. Because LNG is relatively light, a vessel may have a larger volume capacity for a given weight of cargo, as compared to other types of cargo.

One of the challenges for LNG storage tank design may be to ensure that the LNG storage tanks have enough structural integrity to withstand loads due to cargo motion and sloshing. Sloshing is liquid motion within a tank that may be produced by periodic motions (e.g., ships at sea). As the liquid in a tank moves waves may be formed and waves traveling in a fluid contained within a tank of fixed length may interfere with waves that have reflected off the end of the tank and are traveling back in the opposite direction. At certain frequencies, standing waves can be produced and may be a resonance phenomenon. The frequency at which standing waves occur may be called resonant frequencies. When the frequency at which force is applied is near the resonant frequency of the fluid within the tank, large increases in amplitude may occur, possibly resulting in large forces being exerted on the tank.

Sloshing may be a concern for vessels that carry liquids in their storage tanks and may be considered during the design of such ships. Sloshing may become more pronounced when the frequencies of ship motions match frequencies associated with the liquid motion in the storage tanks. The frequencies that may be associated with the liquid motion in the storage tanks may be functions of the tank geometry and the cargo fill levels in the storage tanks.

The sloshing of fluids may result in various problems with the vessel and/or storage tanks. For instance, sloshing related damage to the structure of storage tanks may be the result of a single large load event, or cumulative events. Cumulative damage may be the result of a large number of smaller load events, which combine to progressively degrade the structure of the storage tank, a membrane inside the storage tank and/or an insulation system used to maintain the temperature of the storage tank. Further, sloshing of fluids, such as LNG, can be problematic because it may increase the hydrodynamic loads on a marine vessel's hull structure. Also, sloshing may reduce the stability of the vessel and may promote vaporization of the LNG in the storage tanks.

Accordingly, in determining the type of storage tank to use, sloshing and other limitations have to be considered. For instance, free-standing tanks, such as spherical and prismatic tanks, may provide access to the containment system and hull of the vessel. However, free-standing tanks may require plates, which are thick, heavy and expensive. As a specific example, spherical tanks may have a wall thickness ranging from about 30-60 millimeters (mm), which may add weight and increase cost relative to other storage tanks. Further, the shape of spherical tanks may not match the available space on a vessel, which may result in upper portions of the spherical tanks extending about 15 meters (m) above the main deck. This extension may increase the height of the vessel's center of gravity. The increase in the center of gravity for the vessel may increase the vessel's vulnerability to weather effects (e.g., wind and icing), and require an elevated aft bridge to provide visibility over the spherical tanks. To permit loading form the top, as may be required by regulation, considerable access structures (e.g., ladders, catwalks and piping) may also be added above the deck of vessels fitted with spherical tanks. In addition, some free-standing tanks, such as prismatic tanks, may also require extensive bracing to overcome the loads due to the cargo and the weight of the tank itself.

Further, while avoiding some drawbacks of free-standing storage tanks, particularly in weight and material cost, prismatic membrane tanks may also limit access to the vessel. For instance, the prismatic membrane tanks may limit access to the interior of a vessel's inner hull and the exterior of a storage tank's insulation and secondary barrier.

Accordingly, there is a need for a method to design storage tanks, which may include LNG, $CO_2$, and other fluids, that are configured to store refrigerated/cryogenic fluids and provide suitable strength and stability against movement (e.g. sloshing) of the stored fluid in marine environments. Such a storage tank may be capable of storing large volumes (e.g., 100,000 cubic meters ($m^3$) or more) of fluids and easily fabricated.

Other related material may be found in at least U.S. Pat. No. 3,332,386; U.S. Pat. No. 3,759,209; U.S. Pat. No. 3,941,272; U.S. Pat. No. 5,727,492; U.S. Patent Pub. No. 2004/0172803; U.S. Patent Pub. No. 2004/0188446; U.S. Patent Pub. No. 2005/0150443; Hermundstad, et al., "Hull Monitoring," Society of Petroleum Engineers, Paper No. 61454-MS, pp. 1231-1240, Jun. 26, 2000; and Vandiver, et al., "The Effect of Liquid Storage Tanks on the Dynamic Response of Offshore Platforms," Society of Petroleum Engineers, Paper No. 7285-PA, pp. 1-9, October 1979.

SUMMARY OF THE INVENTION

One embodiment provides a method of designing a storage tank for a floating vessel for storing a liquid. The method generally includes determining an energy spectrum of expected wave forces acting upon the vessel, determining, based on the vessel dimensions, one or more amplification regimes, each defined by a range of periods within which expected wave forces acting upon the vessel are amplified, and designing the tank with dimensions that result in sloshing periods of liquid stored in the tank at expected fill heights that fall outside the one or more amplification regimes. Further, the one or more amplification regimes may include at least two amplification regimes with each of the at least two amplification regimes corresponding to different degrees of freedom of the marine vessel, such as pitch, roll, and surge.

Another embodiment generally provides a floating storage vessel having a hull structure and at least one storage tank disposed in the hull structure, wherein the at least one storage tank has dimensions that result in sloshing periods of liquid stored in the tank at expected fill heights that fall outside the one or more amplification regimes defined by a range of periods within which expected wave forces acting upon the vessel are amplified.

Another embodiment generally provides a ship for transporting liquid generally having a hull structure and at least one storage tank disposed within the hull structure, wherein the at least one storage tank has dimensions that result in sloshing periods of liquid stored in the tank at expected fill heights that fall outside the one or more amplification regimes defined by a range of periods within which expected wave forces acting upon the ship are amplified.

Another embodiment includes a method of importing fluid. The method comprises providing a marine vessel having a hull structure and at least one storage tank disposed in the hull structure, wherein the at least one storage tank has dimensions that result in sloshing periods of a fluid stored in the at least one storage tank at expected fill heights that fall outside the one or more amplification regimes defined by a range of periods within which expected wave forces acting upon the marine vessel are amplified; and offloading the fluid from the marine vessel. Further, the method may include moving the marine vessel with the stored fluid to an import terminal to offload the fluid, and wherein the fluid comprises liquefied natural gas.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Embodiments of the present invention provide a floating fluid storage vessel with a containment chamber for large volumes of liquid so that the stored liquid's motion is between the natural resonance periods of the floating fluid storage vessel. As a result, the resonant energy of the vessel may not be imparted to the contained fluid and, hence, sloshing loads may be reduced to avoid or reduce damage to the vessel and storage tanks.

Exemplary Design Application

Figure 1:
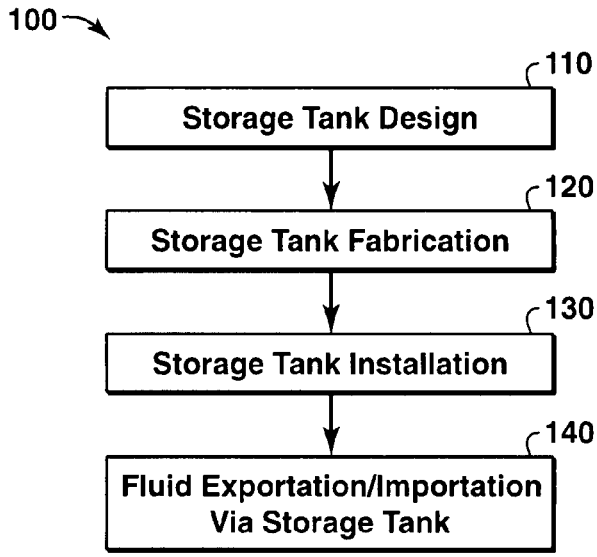
FIG. 1 is a flowchart illustrating a method for exportation and importation of fluids in accordance with one embodiment of the present invention.

When liquefied natural gas (LNG) from remote sources is to be used, a way to import the LNG may be found. FIG. 1 illustrates a method for exportation and importation of fluids 100 in accordance with an embodiment of the current invention. At block 110, a storage tank is designed or specified to meet the requirements of the specific application, for example, utilizing operations discussed in FIG. 2 below. That is, the sloshing potential for the storage tanks may used to design a storage tank that falls outside the resonance regimes of potential sloshing. At block 120, the storage tank is fabricated or procured based on the storage tank design requirements. At block 130, the storage tank is installed in a vessel. Once the tank has been properly installed, fluids exportation and/or importation may occur, as shown in block 140. This may involve storing or loading fluids within the storage tanks, moving the vessel with the stored fluids to another location and offloading the fluids at another location.

Many factors may be considered in designing the storage tank in block 110 and each type of tank may have unique characteristics that have to be considered, as well. Indeed, many types of liquid storage tank designs may be negatively impacted by the effects of sloshing. The negative effects of sloshing may be increased by resonance regimes of a vessel and tank design may be improved by designing and configuring tanks that fall outside these resonance regimes.

Figure 2:
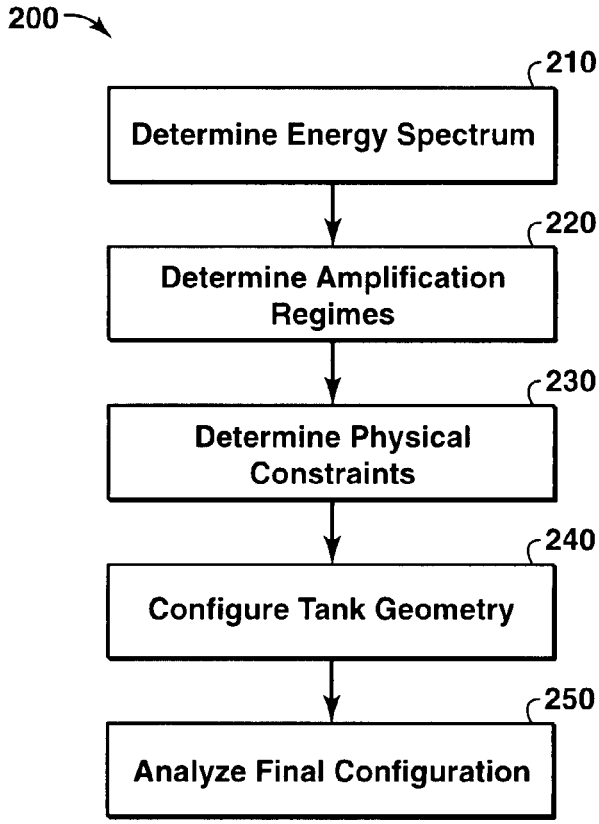
FIG. 2 is a flowchart illustrating a method for determining storage tank geometry in accordance with one embodiment of the present invention.

To determine the design parameters of a storage tank, a number of factors are considered, as shown in FIG. 2. FIG. 2 is an exemplary flow chart 200 of a method for determining design parameters and a configuration for a liquid storage tank, such as liquefied natural gas (LNG) storage tank, for example. While the method may be used for storage tanks in many different environments, floating LNG storage tanks are used for exemplary purposes in this flow chart. At block 210, the energy content in a force's or wave's energy spectrum (e.g., ocean wave) may be determined for a specific geographic region of interest (e.g., waters where a vessel operates). The determination may be made using a variety of sources of data, including experimental data, analytic models, historic data and approximations. For example, the National Oceanographic Data Center maintains a database containing historic data concerning the oceans of the world. Historic data concerning various ocean conditions may also be obtained from the National Oceanic and Atmospheric Administration.

At block 220, amplification regimes may be determined. The amplification regimes may include at least two or more amplification regimes with each of the amplification regimes corresponding to different degrees of freedom of the marine vessel, such as pitch, roll, and surge. As an example, the amplification regimes may include a pitch amplification regime, a roll amplification regime and a surge amplification regime. The regimes may be determined through calculations that may include data regarding the vessel's physical dimensions, the properties of the materials used in the vessel's construction and the forces acting on the vessel. The regimes may also be determined by modeling the vessel, and forces that may act on it, in a computer environment. The regimes may also be modeled through scaled testing or in a computer modeling application. Each of the regimes may extend for one or more units of time, which are expressed in seconds. The pitch, heave and roll regimes of a vessel, such as an LNG carrier (LNGC) or other suitable ship, may easily be excited by wave energy and may be found to be effected by the physical dimensions and construction of the vessel. For moored vessels, surge, sway, and yaw regimes may also be determined. For example, vessels of different lengths and widths may have regimes that occur at different time periods and last for different lengths of time.

At block 230, physical constraints may be determined. These constraints may include available space for storage tanks (e.g., vessel size and configuration), requirements imposed by regulatory and sanctioning bodies, constraints imposed by the operating environment (e.g., docking facilities, waterways and weather). Containment systems for marine storage and transport of LNG may also be considered to provide effective temperature insulation and to prevent heat inflow and unacceptable cooling of the vessel's basic hull structure. For example, LNG may be formed by chilling very light hydrocarbons (e.g., methane and ethane) to approximately −160° Celsius (C.). The LNG may be chilled through a liquefaction process, which may also maximize gas volumes for storage and transportation. Then, the LNG may be stored at ambient pressure in special cryogenic storage tanks, which may be located onshore and in a marine vessel. Accordingly, for the LNG, the containment systems may be constructed of materials designed to withstand extremely low temperatures and large temperature changes.

At block 240, the geometry of the one or more storage tanks may be configured. In configuring the storage tanks, the previously determined wave energy spectrum, amplification regimes and physical constraints may be considered. In an effort to increase efficiency, a storage tank's size, shape, internal configuration, location and orientation may be altered. The geometry of the storage tanks may be designed to ensure that the stored liquid's transverse/longitudinal fluid motion is between, below or beyond the natural resonance periods of the fluid storage vessel (e.g., ship). As a result, the resonant energy of the vessel may be limited or not imparted to the stored fluid in the storage tanks, which reduces the sloshing of the stored fluid.

Once the storage tanks have been configured, the design may be analyzed at block 250. The analysis of the final configuration that occurs at block 250 may include the use of computer models and simulators and the use of scaled models and wave simulators.

Figure 3A:
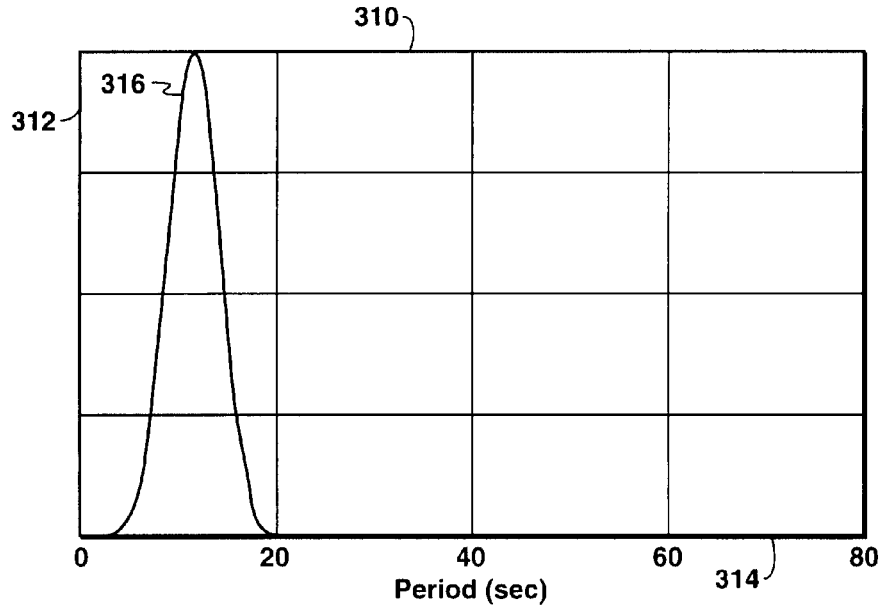
FIGS. 3A and 3B are exemplary graphs of energy content in an ocean wave energy spectrum for pitch, roll and surge periods of a moored vessel.
Figure 3B:
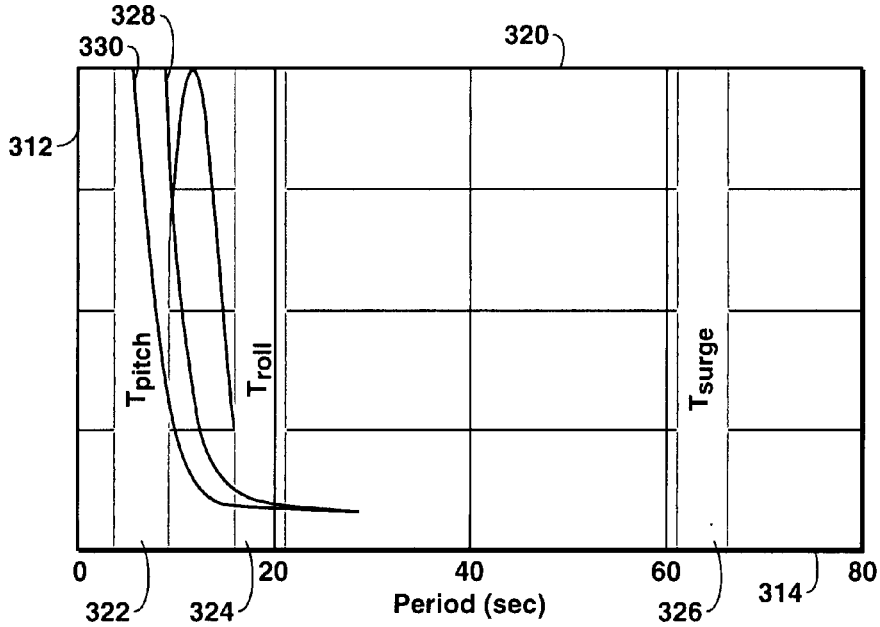

FIGS. 3A and 3B are exemplary graphs of energy content in an ocean wave energy spectrum for pitch, roll and surge periods of a moored vessel. This energy content may include typical sea conditions of a typical vessel's motion amplification regimes. In graph 310, a period and typical energy content in a wave energy spectrum 316 with its magnitude represented on the vertical axis 312 and the period, in seconds (sec), depicted on the horizontal axis 314. The wave energy spectrum 316 represents the energy content in a typical design sea condition. Graph 320 depicts the pitch amplification regime 322, the roll amplification regime 324 and the surge amplification regime 326 for a typical vessel. These regimes 322-324 may be of a typical vessel's motion amplification regimes for a moored vessel. Also depicted, is the longitudinal sloshing period 328 as a function of fill height and the transverse sloshing period 330 as a function of fill height for a typical vessel.

As illustrated in FIGS. 3A and 3B, the pitch amplification regime 322 and roll amplification regime 324 of a typical vessel may be very close to the period of waves in an ocean. As a result, amplification of vessel and cargo motions may occur. Amplification of vessel and stored fluid motions may have undesirable effects, leading to the need to assess the structural response of the storage tank to resonant liquid sloshing. To design an LNG storage and/or transport vessel, different designs or configurations may be considered in an effort to distance the sloshing resonance period 328 of the cargo and the transverse sloshing period 330 of the stored fluid from the period of the wave energy spectrum 316 for the expected waves. Separating the sloshing resonance periods 328 from the wave periods of the wave energy spectrum 316 and the amplification regimes 322-326 (and hence the resonant periods of the vessel) may be accomplished by various approaches, such as subdividing the liquid cargo in the storage tanks.

Figure 4A:
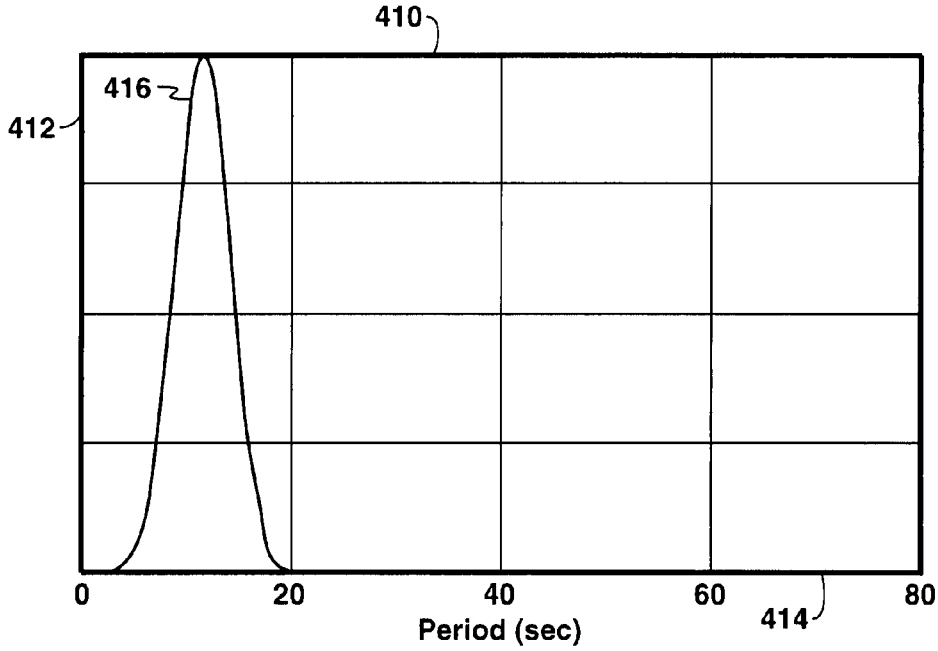
FIGS. 4A and 4B are exemplary graphs of energy content in an ocean wave energy spectrum for pitch, roll and surge periods of a vessel with subdivided cargo in accordance with one embodiment of the present invention.
Figure 4B:
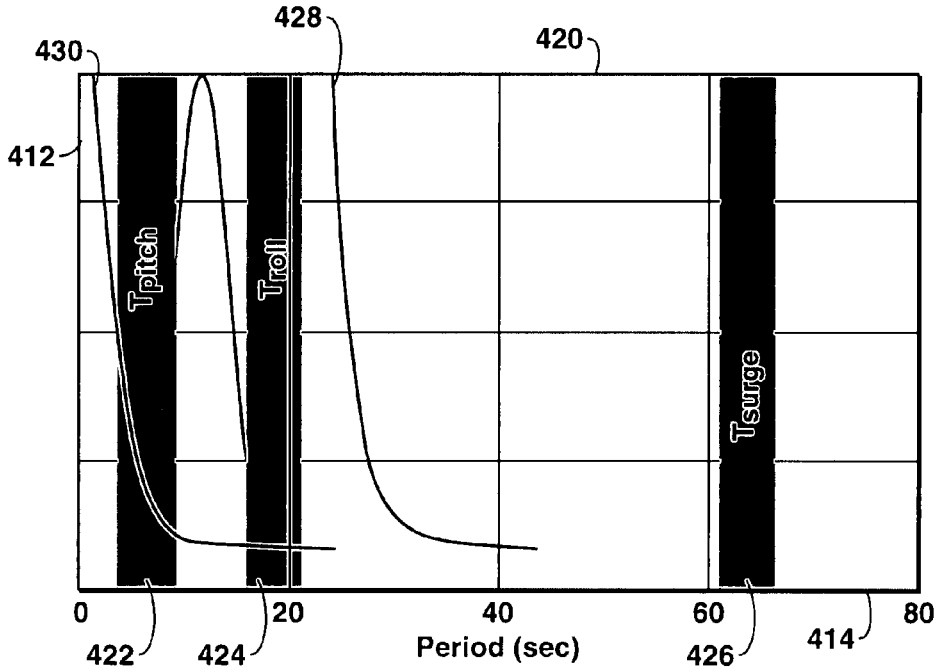

FIGS. 4A and 4B are exemplary graphs of energy content in an ocean wave energy spectrum for pitch, roll and surge periods of a vessel with subdivided cargo in accordance with one embodiment of the present invention. In these FIGS. 4A and 4B, the period and energy content 416 in what may be a typical design sea condition and typical vessel motion amplification regimes 422-426. In FIG. 4A, graph 410 depicts the typical energy content in a wave energy spectrum 416 with its magnitude represented on the vertical axis 412 and the period, in seconds, depicted on the horizontal axis 414. In FIG. 4B, graph 420 depicts the pitch amplification regime 422, the roll amplification regime 424 and the surge amplification regime 426 for a vessel. These amplification regimes 422-426 may be for a typical motion of a moored vessel. Also, the longitudinal sloshing period 428 as a function of fill height and the transverse sloshing period 430 as a function of fill height for a vessel are also shown.

One approach to storage tank design, proposed herein, may reduce the sloshing loads by selecting the storage tank geometry such that the natural sloshing resonance periods 428 and 430 are different from, and do not coincide with, the natural periods of the vessel/waves 416 and 422-426. Typically, sloshing resonance periods for transverse 430 and longitudinal 428 liquid motion modes may be driven by the vessel's rolling and pitch/surge motions. In the proposed subdivision, the stored fluid (e.g. cargo) may be subdivided into long storage tanks with dimensions chosen in an effort to achieve the separation of sloshing resonance periods 428 and 436 from the natural periods of the vessel in its operating environment (e.g. marine environment).

As shown in FIGS. 4A and 4B, the geometry of the storage tanks may be designed such that amplification of the transverse sloshing period 430, as a function of fill height, caused by the energy content of the waves 416 in a specified design sea condition or marine environment is minimized. In such a design, stress on the storage tanks walls may be reduced and damage to the storage tank walls may be avoided or reduced by ensuring the longitudinal and transverse sloshing periods 428 and 430 are not amplified by the periods of the vessel's amplification regimes 422-426 (e.g., pitch, surge and roll). Thus, the dimensions of the storage tank may be designed such that the longitudinal resonance periods 428 are substantially higher than that typically observed from ocean waves, but lower than the surge periods of the vessel to limit surge-excited resonance of the stored fluids in the storage tanks.

Figure 5:
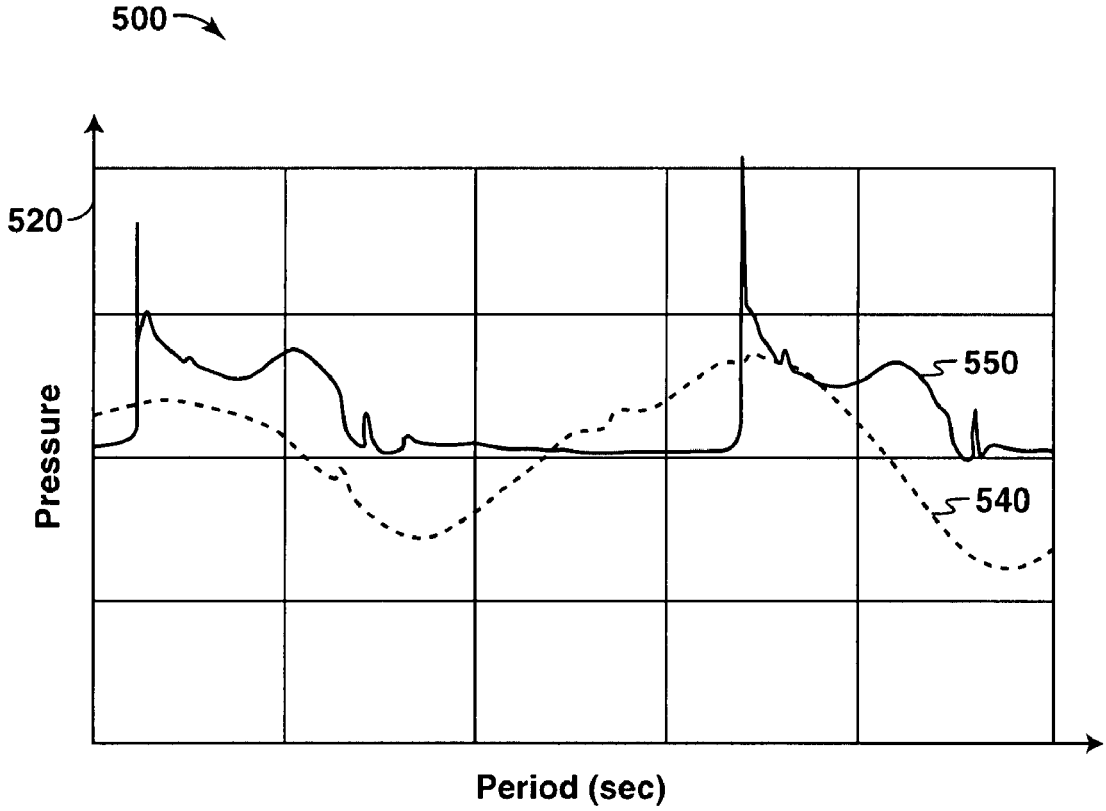
FIG. 5 is an exemplary graph of pressures induced by sloshing on the walls of a storage tank in accordance with one embodiment of the present invention.

As a result of the storage tank dimensions, sloshing induced pressures on the storage tank walls may be of the non-resonant type, as show in FIG. 5. In FIG. 5, a graph 500 depicts pressure on the vertical axis 520 and time in sec on the horizontal axis 530. It may be observed that the impact pressure traces for resonant sloshing 550 may be greater than pressure traces for non-resonant sloshing 540. By reducing or eliminating resonant sloshing, the pressure experienced by storage tanks may be significantly reduced. As such, the storage tanks may be configured to reduce resonant type sloshing induced pressures on the storage walls of the tank.

Exemplary Application for Floating Storage Vessels

In addition to the configuration of the storage tanks, other equipment, such as processing equipment, may be located on the main deck of the vessel. For example, processing equipment may include liquefaction equipment utilized to make liquefied natural gas (LNG) from feed gas or regasification equipment to vaporize the LNG. The addition of processing equipment may add weight to the vessel, may require alteration of the vessel's physical dimensions and may effect the amplification regimes associated with the vessel. Floating storage vessels may also have design criteria that are different from vessel's designed for transportation. As an example, floating storage vessels may be required to store larger quantities of LNG than transport vessels, may be required to support processing equipment and may be designed to be relatively stationary.

Figure 6A:
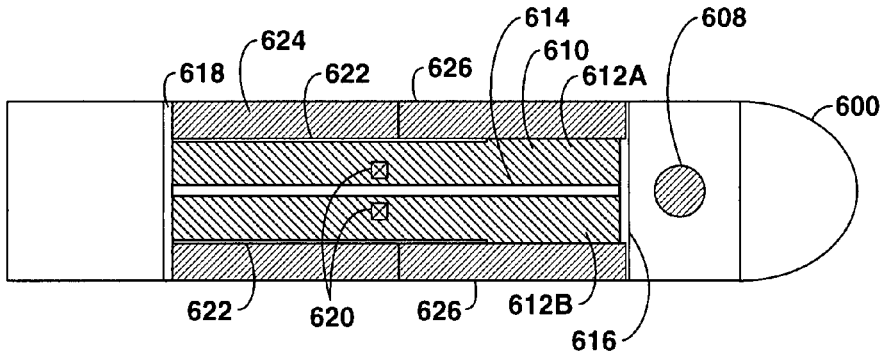
FIGS. 6A-6C are an exemplary turret moored tank system in accordance with one embodiment of the present invention.
Figure 6B:
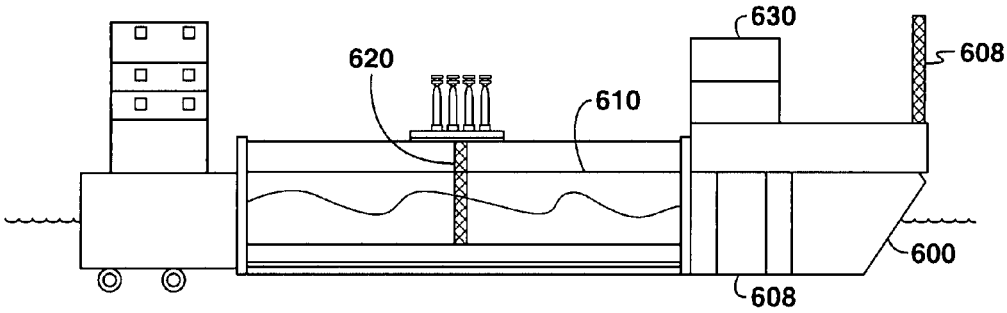

FIGS. 6A-6B depicts a double hull vessel 600 having a turret moored FSRU/FLSV system 608. The vessel 600 may include a fluid storage chamber 610 within the cargo area, which is divided into two storage tanks 612A and 612B by a longitudinal centerline cofferdam 614. The two liquid storage chambers may be bounded in the aft by a cofferdam 618 and forward by a cofferdam 616. Each of the fluid storage tanks 612A and 612B may also contain a pump tower 620, which is used in pumping LNG into, or out of, the storage tanks 612A and 612B. The inside shell (e.g. inner hull) 622 of the vessel 600 may provide starboard and port boundaries of the fluid storage chamber 610 and may contain water ballasts and void spaces 624 that may extend to the outer shell 626 of the vessel 600. Vaporization/liquefaction equipment 630 may also be located on the deck, forward of the storage tanks 612 and near the turret 608.

Figure 6C:
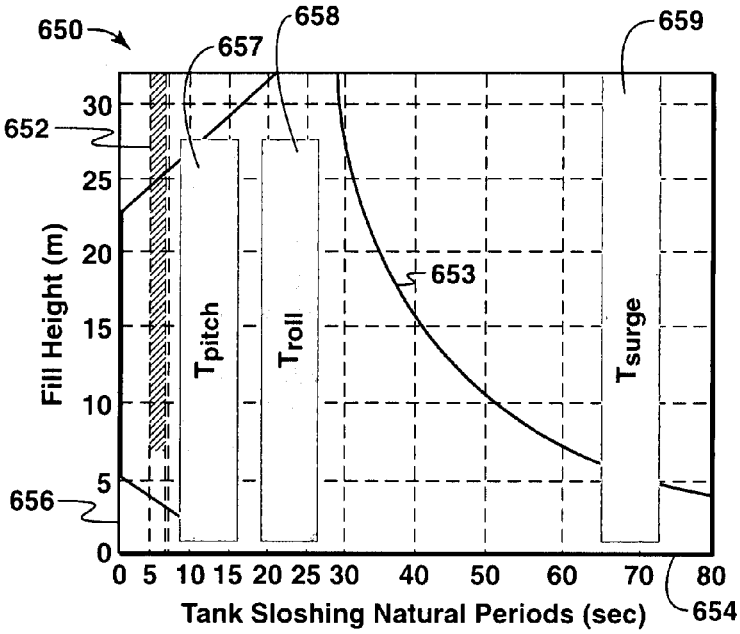

FIG. 6C depicts a graph 650 of transverse sloshing period 652 and longitudinal sloshing period 653 are shown against the tank sloshing natural periods 654 in seconds and the fill height 656 in meters (m). Also, the pitch period 657, roll period 658 and surge period 659 are shown in relation to the transverse sloshing period 652 and longitudinal sloshing period 653. In this configuration for the vessel 600, the transverse sloshing period 652 does not overlap with the periods for pitch period 657, roll period 658 and surge period 659. Also, the longitudinal sloshing period 653 does not overlap with the periods for pitch period 657 and roll period 658. While the longitudinal sloshing period 653 does overlap with the surge period 659, this overlap is at a reduced fill height 656. As such, the storage tank(s) in the vessel 600 are configured or designed to have transverse and longitudinal sloshing periods 652 and 653 that fall outside the resonance periods 657, 658, and 659 to reduce or minimize potential sloshing damage to the storage tanks and vessel 600.

Figure 7A:
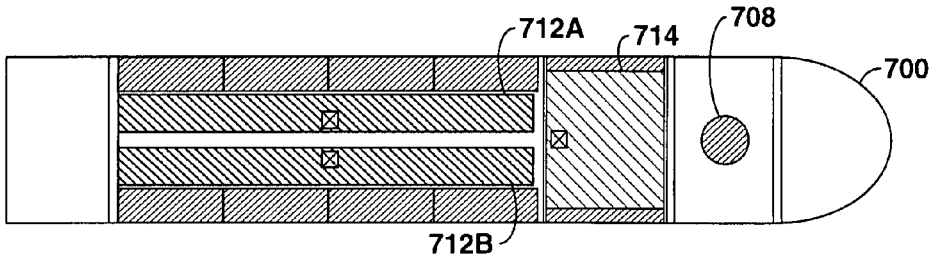
FIGS. 7A-7C is an exemplary turret moored tank system in accordance with one embodiment of the present invention.
Figure 7B:
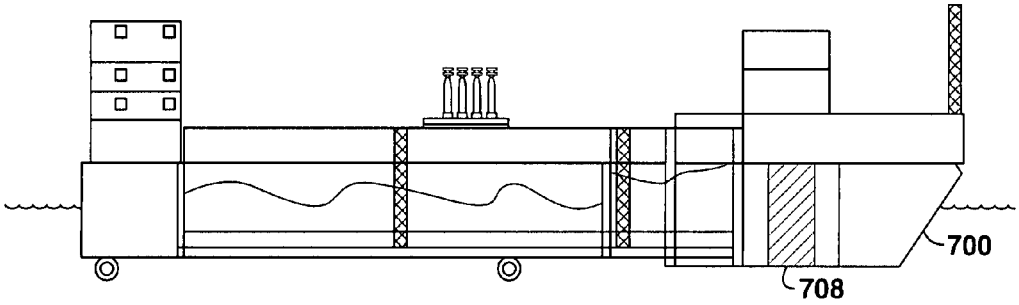

FIGS. 7A-7B depict a double hull vessel 700, which may be a moored floating storage and regasigication unit (FSRU)/floating liquefaction and storage vessel (FLSV) having a turret 708 and two storage tanks 712A and 712B along with a membrane storage tank 714. The membrane storage tank 714 may be located forward of the two storage tanks 712A and 712B and may be used to increase storage volume onboard the vessel 700. Additional storage capacity may be desirable for high send-out floating storage and regasification vessel (FSRU) designs. There may also be cases where it is desirable to decouple the production rate from the rate at which the LNG may be transferred to trading tankers and in such case additional storage may also be required.

Figure 7C:
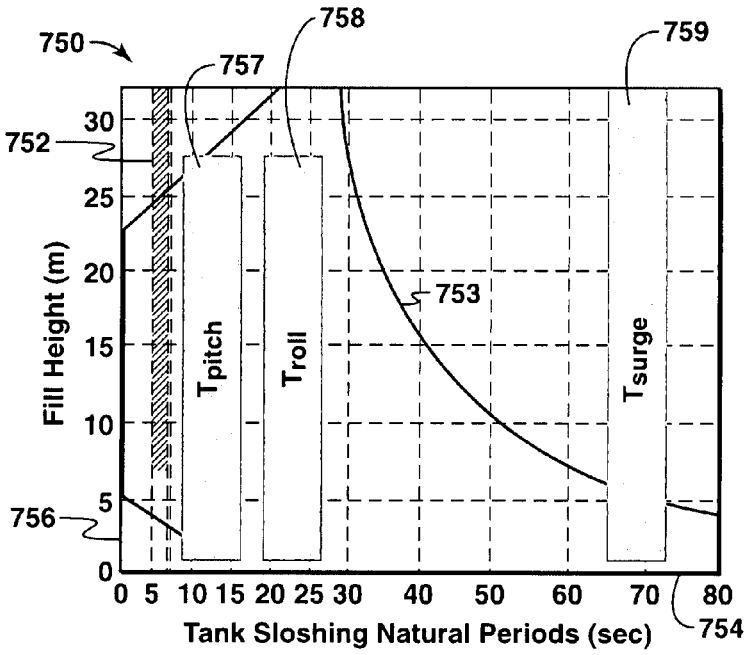

FIG. 7C depicts a graph 750 of transverse sloshing period 752 and longitudinal sloshing period 753 are shown against the tank sloshing natural periods 754 in seconds and the fill height 756 in meters (m). Also, the pitch period 757, roll period 758 and surge period 759 are shown in relation to the transverse sloshing period 752 and longitudinal sloshing period 753. In this configuration for the vessel 700, which is similar to the discussion of FIG. 6C, the transverse sloshing period 752 does not overlap with the periods for pitch period 757, roll period 758 and surge period 759. Also, the longitudinal sloshing period 753 does not overlap with the periods for pitch period 757 and roll period 758. While the longitudinal sloshing period 753 does overlap with the surge period 759, this overlap is at a reduced fill height. As such, the storage tank(s) in the vessel 700 are configured or designed to have transverse and longitudinal sloshing periods 752 and 753 that fall outside the resonance periods 757, 758, and 759 to reduce or minimize potential sloshing damage to the storage tanks 712A, 712B, and 714 and vessel 700.

Figure 8A:
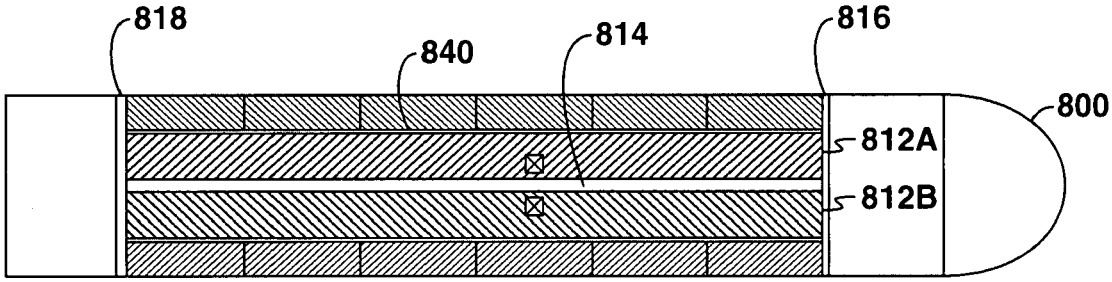
FIGS. 8A-8B is an exemplary LNG carrier with two storage tanks separated by a centerline cofferdam in accordance with one embodiment of the present invention.
Figure 8B:
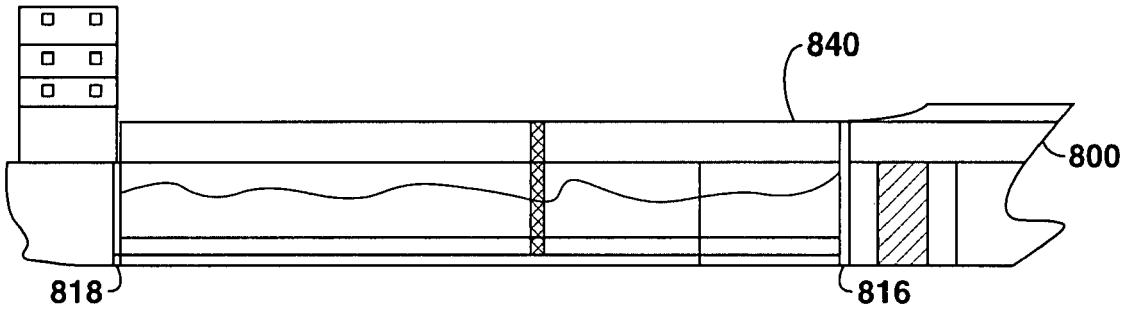

FIGS. 8A-8B depict an exemplary membrane LNG carrier 800 having two storage tanks 812A and 812B in a cargo area 840. The vessel 800 may be about 326 meters in length and may be about 54.8 meters wide. Each of the storage tanks 812A and 812B may be approximately 212 meters in length, about 14.5 meters in width, and have a height of 32.5 meters, having a volume of about 100 KCM (100,000 cubic meters). The storage tanks 812A and 812B may be separated by a centerline cofferdam 814 that runs the length of the storage tanks 822A and 822B. Transverse cofferdams 816 and 818 may separate the storage tanks 812A and 812B from the other areas on the vessel 800.

Exemplary Transport Application

Figure 9:
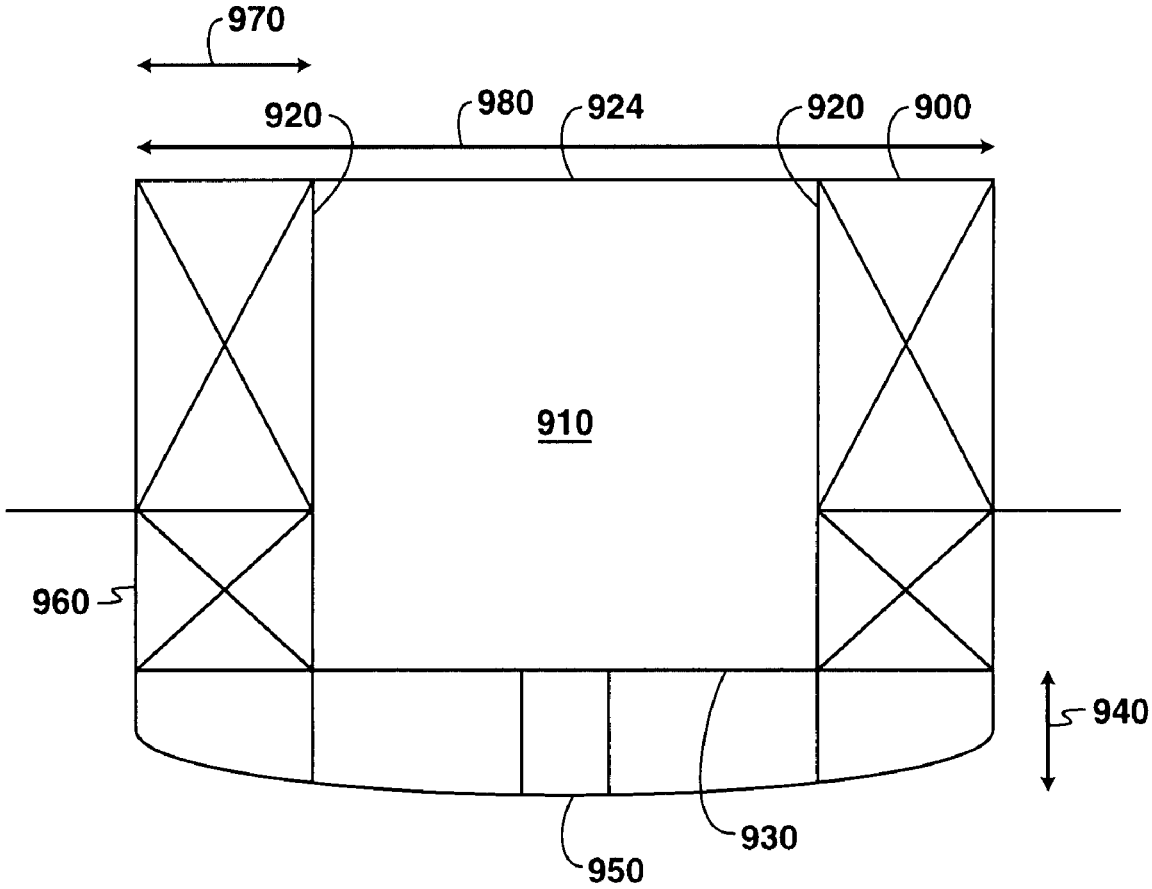
FIG. 9 is an exemplary of a cross section of a vessel in accordance with one embodiment of the present invention.

In one embodiment, which is depicted in FIG. 9, a vessel 900 has a cargo area 910 with side walls or boundaries 920 that are located a distance 970 from an outer side hull 960 of the vessel 900. The vessel 900 may have a cross sectional distance 980 from one side to the other side of the outer hull 960. The cargo area 910 may have an upper boundary 924 and a bottom boundary 930 that are located a distance 940 from an outer bottom hull 950. One or more tanks, of the same or varied construction type, may be placed within the cargo area 910 and utilized to store fluids. The number of tanks and their construction may depend on other constraints (e.g., vessel length, vessel width and vessel displacement) and the desire to limit increased pressures and damage that can occur due to sloshing.

As an example, if the vessel 900 is an LNG vessel (e.g., transport and floating storage facilities), the vessel 900 may have hulls configured to hold cryogenic tanks. These vessels may have double hulls, which may include a double bottoms and double sides. The double hull configuration provides a measure of protection to the cargo in the event of damage to the vessel 900. That is, the outer hull may be damaged, but seawater may not contact the storage tanks on the vessel unless the inner hull is also penetrated. Accordingly, in this configuration, the outer side hull 960 and the outer bottom hull 950 may be the outer hull of the double hull vessel.

As a specific embodiment, the vessel 900 may have a cross sectional distance 980. This distance 980, which may be referred to as a length B, may be in a range from 30 meters to 57.5 meters, or larger depending on the specific vessel's cross sectional dimensions. The side walls 920 of the cargo area 910 may be positioned a distance 970 from the outer hull 960 of the vessel 900. This distance 970 may be a length B/5, within a range from about 6 meters to about 11.5 meters, or larger depending on the vessel's cross sectional distance 980. Also, in the configuration, the bottom boundary 930 of the cargo area 910 may be a distance 940 from the outer bottom hull 950. This distance 940 may be in the lower of the length B/15 or about 2 meters. In a particular embodiment, the length of the storage tank may be greater than about 260 meters and/or the width of the vessel may be greater than about 55 meters.

The cargo area 910 may be utilized to store any of a number of different types of storage tanks. For instance, if the stored fluid is LNG, the storage tanks may include insulated prismatic membrane storage tanks and independent storage tanks. To carry stored fluids at temperatures lower than that of the ambient air, the vessel 900 may be configured to house one or more cold boxes. The term cold box generally refers to a single or doubled wall box, which may be constructed of carbon steel plates. Cold boxes may be filled with insulation, such as perlite, and may house storage tanks, piping and other cryogenic process equipment. A cold box may also be constructed of insulating panels to provide for easier access to the contents.

Further, the cargo area 910 may be configured to transport one or more independent tanks. Independent tanks are generally self-supporting and rely upon their foundations to transmit gravitational forces along with other forces that may be attributed to the weight of the independent tanks and the weight of the stored fluid, the bottom boundary 930 and the surrounding hull structure. Because of their design, independent tanks may be capable of being placed within the cargo area 910 at a distance separate from the hull structure adjacent to the side boundaries 920. These independent tanks may be constructed of aluminum alloy, although 9% nickel steel and stainless steel may also be acceptable.

Independent tanks may also be sufficiently robust to independently withstand hydrostatic and hydrodynamic forces and may be able to transmit these forces to the surrounding hull structure or boundaries 920 and 930 through their foundation support system. Independent tanks may be designed to accommodate thermally induced stresses, which may be caused by the temperature difference between ambient and LNG cargo service temperatures. There are two types of independent tanks, per the International code for the construction and equipment of vessels carrying liquefied gases in bulk (IGC code) Type A and Type B.

Embodiments of the present invention may also utilize independent prismatic tanks. A prismatic tank may be a tank that is shaped to follow the contours of the cargo area 910. It may be the case that the footprint of the tank top and tank bottom need not be of equal size. Free-standing (or independent) prismatic tanks may make more efficient use of the below-deck volume compared to spherical tanks. Prismatic tanks may also avoid the necessity of having a structure high above the cargo area's upper boundary 924. By not having a structure high above the cargo area's upper boundary 924, prismatic designs may avoid raising the vessel's center of gravity, may reduce the effects of wind and icing and may have application in high latitudes, such as near artic regions. The size, shape, configuration and internal structures of independent prismatic tanks may effect the transverse sloshing period and the longitudinal sloshing period of the fluid in the tank and may be considered during analysis.

Embodiments of the present invention may utilize membrane tanks constructed in the cargo area 910. Membrane tanks are non-self supporting tanks which may consist of a thin layer (membrane) supported, through insulation, by the adjacent hull structure. The membrane may be designed in such a way that thermal and other expansion or contraction is compensated for without undue stressing of the membrane. The boundaries 920, 924 and 930 of the cargo area may help the membrane maintain shape and integrity and may help to absorb the hydrostatic forces which may be imposed by the tank's contents. For the boundaries 920, 924 and 930 of the cargo area to provide support for the membrane, it may be necessary for the membrane to be in intimate contact with the surrounding hull structure at virtually all points.

Membrane containment systems may be constructed of stainless steel or alloys of various metals (e.g., iron, nickel carbon and chromium). It may be desirable for the materials making up the membrane containment system to have minimal thermal expansion characteristics. These materials may be substantially more costly per unit weight than the aluminum alloy of typical independent tanks. However, these materials may be designed into competitive systems owing to the relative thinness and resulting light weight characteristics of the membrane. The membrane may not be capable of independently withstanding the forces encountered and may rely on a load-bearing insulation system to transmit forces to the hull structure.

The amount of force encountered by the membrane tank and transmitted to the hull structure may be reduced by ensuring that the transverse sloshing period and the longitudinal sloshing period of fluids stored in the membrane containment system do not coincide with the vessel's amplification regimes. By designing tanks that ensure that the sloshing periods of fluid stored within a vessel do not fall within the amplification regimes of that vessel, fluids may be transported with more efficiency and greater safety.

While the foregoing is directed to embodiments of the present invention, other and further embodiments of the invention may be devised without departing from the basic scope thereof, and the scope thereof is determined by the claims that follow.

I claim:

1. A method of designing a storage tank to store a fluid for a marine vessel, the method comprising:

determining an energy spectrum of expected wave forces acting upon a marine vessel;

determining one or more amplification regimes based on vessel dimensions of the marine vessel, each of the one or more amplification regimes have a range of periods within which expected wave forces acting upon the marine vessel are amplified;

designing the storage tank to have physical dimensions that provide sloshing periods in the storage tank outside the one or more amplification regimes; and determining sloshing periods for one or more combinations of physical dimensions and fill heights.

2. The method of claim 1, wherein the storage tank is designed with dimensions that provides a volume of at least 100,000 cubic meters.

3. The method of claim 1, wherein a length of the storage tank is at least 260 meters.

4. The method of claim 1, wherein the one or more amplification regimes comprise at least two amplification regimes with each of the at least two amplification regimes corresponding to different degrees of freedom of the marine vessel.

5. The method of claim 1, wherein the fluid comprises liquefied natural gas.

6. The method of claim 1, wherein the marine vessel is configured to transport the fluid in a marine environment.

7. The method of claim 1, wherein designing the storage tank comprises longitudinally dividing the storage tank with a separating structure to separate sloshing periods from amplification regimes.

8. The method of claim 1, wherein the physical dimensions of the storage tank results in a natural resonance period of sloshing of liquid in the storage tank at expected fill heights that falls between natural resonance periods of the marine vessel.

9. The method of claim 1, further comprising utilizing the marine vessel to transport fluids stored in the storage tank.

10. The method of claim 1, further comprising storing fluids in the storage tank while the marine vessel is moored in a body of water.

11. A method of importing fluid comprising:

providing a marine vessel having a hull structure and at least one storage tank disposed in the hull structure, wherein the at least one storage tank has dimensions that result in sloshing periods of a fluid stored in the at least one storage tank at expected fill heights that fall outside one or more amplification regimes defined by a range of periods within which expected wave forces acting upon the marine vessel are amplified, wherein the one or more amplification regimes comprise at least two amplification regimes with each of the at least two amplification regimes corresponding to different degrees of freedom of the marine vessel; and offloading the fluid from the marine vessel.

12. The method of claim 11, further comprising moving the marine vessel with the fluid to an import terminal to offload the fluid.

13. The method of claim 11, wherein the fluid comprises liquefied natural gas.

14. A method of designing a storage tank to store a fluid for a marine vessel, the method comprising:

determining an energy spectrum of expected wave forces acting upon a marine vessel;

determining one or more amplification regimes based on vessel dimensions of the marine vessel, each of the one or more amplification regimes have a range of periods within which expected wave forces acting upon the marine vessel are amplified, wherein the one or more amplification regimes comprise at least two amplification regimes with each of the at least two amplification regimes corresponding to different degrees of freedom of the marine vessel; and designing the storage tank to have physical dimensions that provide sloshing periods in the storage tank outside the one or more amplification regimes.

15. The method of claim 1, wherein the storage tank is designed with dimensions that provides a volume of at least 100,000 cubic meters.

16. The method of claim 1, wherein a length of the storage tank is at least 260 meters.

17. The method of claim 1, wherein the fluid comprises liquefied natural gas.

18. The method of claim 1, wherein the marine vessel is configured to transport the fluid in a marine environment.

19. The method of claim 1, further comprising determining sloshing periods for one or more combinations of physical dimensions and fill heights.

20. The method of claim 1, wherein designing the storage tank comprises longitudinally dividing the storage tank with a separating structure to separate sloshing periods from amplification regimes.

21. The method of claim 1, wherein the physical dimensions of the storage tank results in a natural resonance period of sloshing of liquid in the storage tank at expected fill heights that falls between natural resonance periods of the marine vessel.

22. The method of claim 1, further comprising utilizing the marine vessel to transport fluids stored in the storage tank.

23. The method of claim 1, further comprising storing fluids in the storage tank while the marine vessel is moored in a body of water.

* * * * *